US005883579A

United States Patent [19]

Schreiner et al.

[11] Patent Number: 5,883,579

[45] Date of Patent: Mar. 16, 1999

[54] GARAGE DOOR STATUS INDICATING SYSTEM

[76] Inventors: Barbara Schreiner, 9215 Bluejack La., Roswell, Ga. 30076-3609; Terry Schofield, 10780 Bridge Creek Dr., Pensacola, Fla. 32506

[21] Appl. No.: 912,080

[22] Filed: Aug. 15, 1997

[51] Int. Cl.[6] ..... G08B 21/00

[52] U.S. Cl. ..... 340/686; 340/539; 340/550; 340/551; 340/552; 340/545; 340/547

[58] Field of Search ..... 340/686, 545, 340/547, 552, 551, 550, 538, 557, 586, 689, 546

[56] References Cited

U.S. PATENT DOCUMENTS

| | | | |
|---|---|---|---|
| 3,641,540 | 2/1972 | Cutler et al. | 340/545 |
| 4,074,269 | 2/1978 | Hartley | 340/545 |
| 4,583,081 | 4/1986 | Schmitz | 340/545 |
| 4,609,910 | 9/1986 | Geringer et al. | 340/545 |
| 5,341,123 | 8/1994 | Schuman, Sr. et al. | 340/546 |
| 5,402,105 | 3/1995 | Doyle et al. | 340/545 |
| 5,499,014 | 3/1996 | Greenwaldt | 340/539 |
| 5,589,747 | 12/1996 | Utke | 318/468 |
| 5,689,236 | 11/1997 | Kister | 340/545 |

*Primary Examiner*—Nina Tong

[57] ABSTRACT

The present invention is a system which will activate an alarm when a garage door is opened. The system in a transmitter unit and a receiver unit. The transmitter unit is attached in proximity to the garage door. The receiver unit is located within a vehicle stored in the garage. The transmitter unit includes a signal generator which activates and transmits radio frequencies (RF) to the second unit. For activation, once the garage door is in an opened position, the transmitter sends a signal to the receiver. The receiver activates an alarm.

13 Claims, 7 Drawing Sheets

GARAGE DOOR STATUS INDICATING SYSTEM

BACKGROUND OF THE INVENTION

1. Field of the Invention

The present invention relates generally to a garage door status indicating system and more particularly to a system which transmits an warning means when the garage door is in an opened position.

2. Description of the Prior Art

For many, a typical work day can start out chaotically, with the individual rushing out the door, opening their garage door, and enter their automobile which is housed within the garage. With so many concerns on their mind, the individual may exit their garage and forget to close its door. During increment weather conditions, this mistake can cost several hundreds of dollars, should water, snow, or the like, penetrate, rust and/or damage items which are typically stored in the conventional garage. Even worse, an opened garage door can be an invitation for theft. Others, after exiting the garage and traveling some distance, may be left wondering if the door was left opened. This individual is usually left with a persistent doubt and cannot continue with their day unless he returns to his home in order to see the status of his garage door.

To ease in the exiting and entering of a garage, automatic garage door openers exists. Most of the garage door openers today require the user to utilize a remote for closing and opening the door. These remotes may offer convenience, but they do not offer any solution to the problems identified above.

Accordingly, it is seen that there exists a need to provide a warning means when a garage door is in an open position. Previous efforts do not provide the benefits intended with the present invention. Additionally, prior techniques do not suggest the present inventive combination of component elements as disclosed and claimed herein. The present invention achieves its intended purposes, objectives and advantages over the prior art device through a new, useful and unobvious combination of component elements, which is simple to use, with the utilization of a minimum number of functioning parts, at a reasonable cost to manufacture, assemble, test and by employing only readily available material.

SUMMARY OF THE INVENTION

The present invention provides a system which will indicate the status of a garage door. This door status system can be incorporated and utilized for several types of situations, such as: 1) safety applications, for example, being able to detect the status of the garage door for closing the door in order to deter small children from entering a potentially hazardous environment; 2) security applications, for instance, prohibiting potential thieves from easily entering the dwelling and 3) aesthetic purposes, as an example, providing a closed door will hid and camouflage messy and untidy areas within the garage.

The system includes two units. The first unit is transmitter unit and this unit is attached in proximity to the garage door. The second unit is the receiving unit and it is located in or on the vehicle stored within the garage. It is noted that each vehicle located within the garage can include the second unit to provide for a final product which includes one first unit and a plurality of second units.

The first unit or transmitter unit includes a signal generator which activates and transmits radio frequencies (RF) to the second unit.

The second unit or receiver unit may include sensor device which will activate the unit. The sensor is design to active once a motion or movement is located within its path. In this case, the path is the interior area of a conventional vehicle. To provide proper single transmission, an ultrasonic sensor or a passive infrared sensor can be used to detect the presence of an individual within the specified field. If either type of sensor is used, then once presence or motion is detected, a signal is transmitted in order to activate the second unit or receiver. The use of the sensor will enable the receiver to be utilize.

Yet another sensor which can be used is a microwave motion sensor, which detects the Doppler shift of the reflected microwave signal from the movement of the individual once he is located within a specified field. Once detected, a first signal is generated and causes the activation of the warning means.

The second unit also contains a warning means. Accordingly, once the second unit is open, i.e. by the driver entering the vehicle, and a frequency is received via the opening of the garage door, a warning means is activated. The warning means can be any type of conventional warning means, such as, but not limited to, audible means, visual means, or a combination thereof.

The system can further include a silencer button which can be activated for disabling the warning means. This would be beneficial should the user decide to open the garage door and remove the car for washing, cleaning, maintenance, or the like.

Accordingly, it is the object of the present invention is to provide for a garage door status indicating system which will overcome the deficiencies, drawbacks and shortcomings of prior garage door devices and methods thereof.

It is yet another object of the present invention to provide for a garage door status indicating system which can easily be installed onto an existing garage door without requiring any changes or alteration to the garage or home's wiring.

Still another object of the present invention is to provide for a garage door status indicating system that can be install or retrofitted into existing and conventional electronic garage door's opening system.

Yet another of the present invention, to be specifically enumerated herein, is to provide a garage door status indicating system in accordance with the preceding objects and which will conform to conventional forms of manufacture, be of simple construction and easy to use so as to provide a device that would be economically feasible, long lasting and relatively trouble free in operation.

Although there have been many inventions related to a garage door openers, none of the inventions address the concerns as identified above, such as providing a warning means when the garage door is in an opened position. The present invention meets the requirements of the simplified design, compact size, low initial cost, low operating cost, ease of installation and maintainability, and minimal amount of training to successfully employ the invention.

The foregoing has outlined some of the more pertinent objects of the invention. These objects should be construed to be merely illustrative of some of the more prominent features and application of the intended invention. Many other beneficial results can be obtained by applying the disclosed invention in a different manner or modifying the invention within the scope of the disclosure. Accordingly, a fuller understanding of the invention may be had by referring to the detailed description of the preferred embodiments in addition to the scope of the invention defined by the claims taken in conjunction with the accompanying drawings.

BRIEF DESCRIPTION OF THE DRAWINGS

Similar reference numerals refer to similar parts throughout the several views of the drawings.

DESCRIPTION OF THE PREFERRED EMBODIMENTS

Figure 1A:
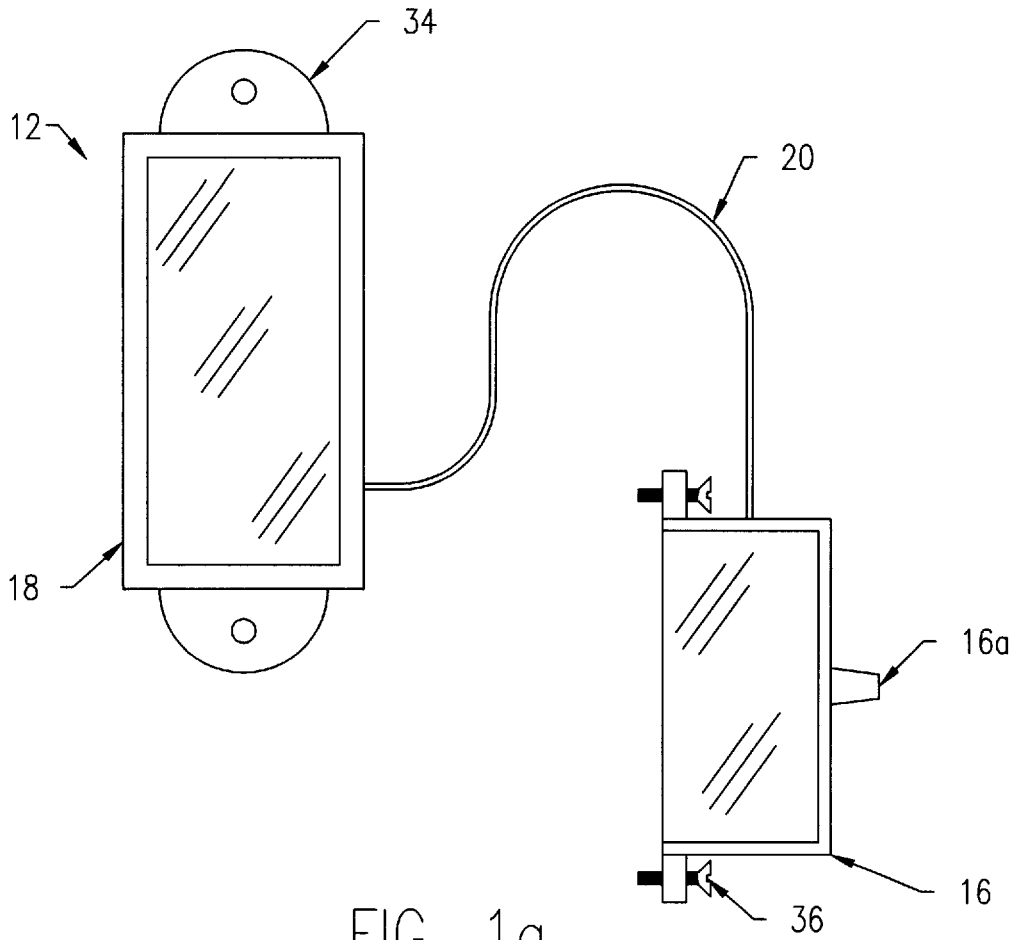
FIG. 1*a* is a perspective view of the first device used in the garage door status indicating system of the present invention.

With reference to drawings, and in particular to FIGS. 1*a*–6 thereof, the garage door status indicating system of the present invention will be described. As seen, the garage door status indicating system 10 of the present invention comprises a first device 12 and a second device 14. The first unit is designed and configured to be secured in proximity to a conventional garage door GD, as illustrated in FIGS. 2*a*, 2*b*, 3*a*, 3*b* and 4. Upon the opening of the garage door GD, the first unit 12 will transmit a signal to the second unit 14 for the activation of a warning means for alerting the user that the garage door GD is in an opened position. This warning means will remain active until the garage door GD is in a closed position.

The first device 12, illustrated in further detail in FIGS. 1*a*, 2*a*, 2*b*, 3*a*, 3*b*, 4 and 5, is a transmitter unit. As seen in these drawings, the transmitter unit 12 is compact in size and is to be installed in proximity to a conventional garage door GD. This first device 12 comprises a door switch 16 and a radio frequency (RF) transmitter 18. As seen in the drawings, the door switch 16 is coupled to a radio frequency (RF) transmitter 18 via wiring 20. This wiring is both a mechanical and electrical connection and will allow for current to flow from the door switch 16 to the radio frequency transmitter 18. In operation, when the garage door is opened, it will cause the switch 16 to close. This closed switch will allow current to flow via line 20 to the transmitter 18 for activation. Signals will then be transmitted to the second device for appropriate activation.

Figure 2A:
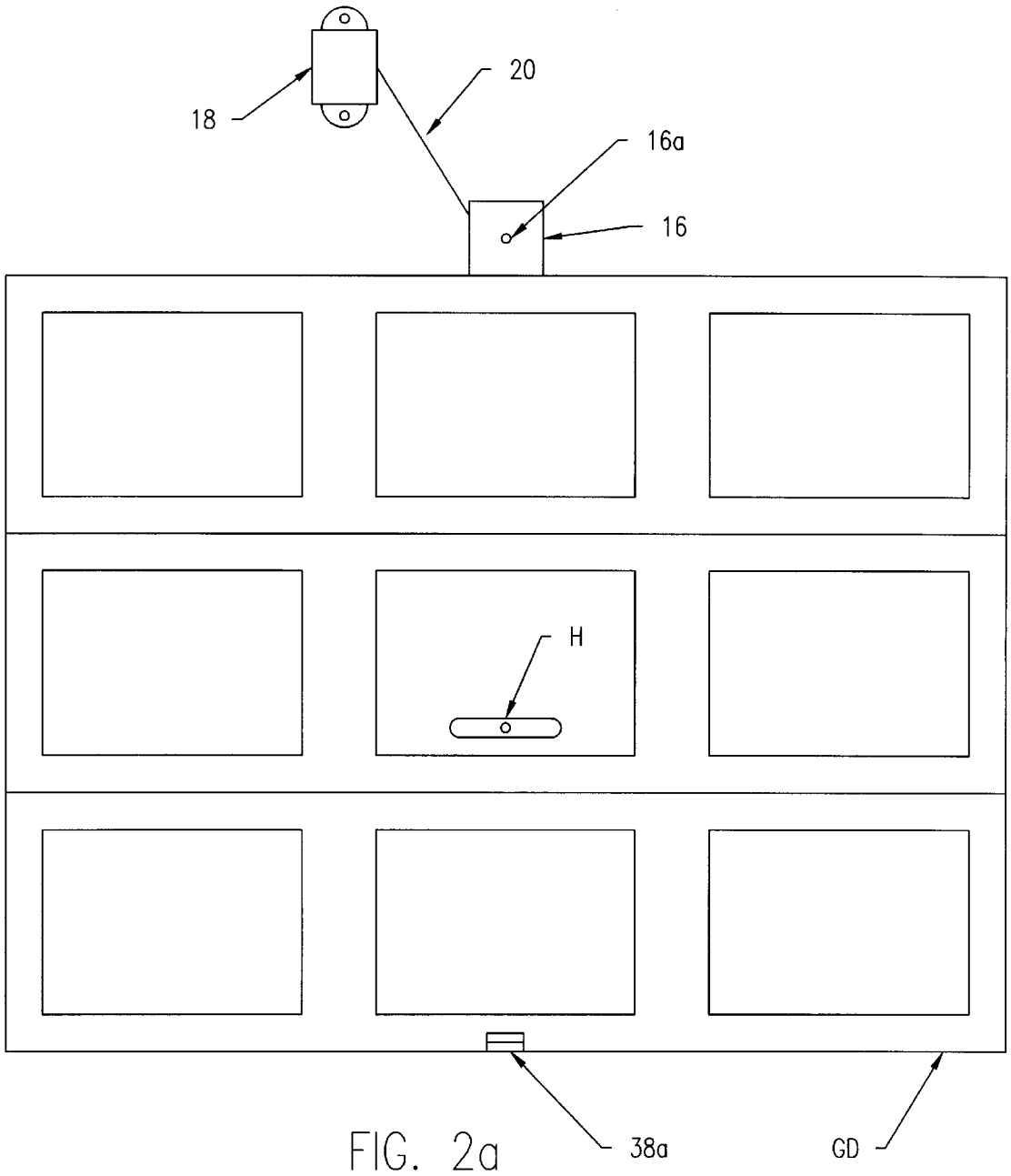
FIG. 2*a* is a front view of the first device of the garage door status indicating system attached above a conventional garage door in a first position and uses a conventional bracket from the garage door for activating the system.

In the first position of the present invention, illustrated in FIG. 2*a*, the warning means will activate once the door is completely opened. This figure illustrates the one arrangement for the system of the present invention. As seen in FIG. 2*a*, the switch 16, having a depressable button 16*a*, is arranged in proximity to the garage door GD. The switch 16, is located above the door. Once the button 16*a* is depressed, the system 10 will be activated. Since the switch is located above the door, the depression of the button 16*a* occurs when the door is completely opened.

As further shown in this figure, conventional garage doors include handles H for allowing a user to open and lock the door. Once a door is in an opened position, the user can close the door by pulling down on the conventional L-shape bracket 38*a* located on the lower area of the garage door GD or optionally, some owners will attach a rope or the like to the L-shape bracket 38*a* for allowing the user to easily pull down on the rope, or the like, for consequently pulling the garage door down and into a closed position. This bracket 38*a* is conventional and is designed and configured to be secured in proximity to the lower area of the garage door.

In this first arrangement of the present invention, this convention bracket 38*a* can be used for activating or depressing the button 16*a* on the switch 16 when the door is in an opened position. In this embodiment, illustrated in FIG. 2*a*, it is seen that the switch 16 must be linearly aligned with the conventional L-shape bracket 38*a*. Thereby, once the door is in an opened position, the conventional bracket 38*a* will contact and depress the button for activating the device.

Figure 2B:
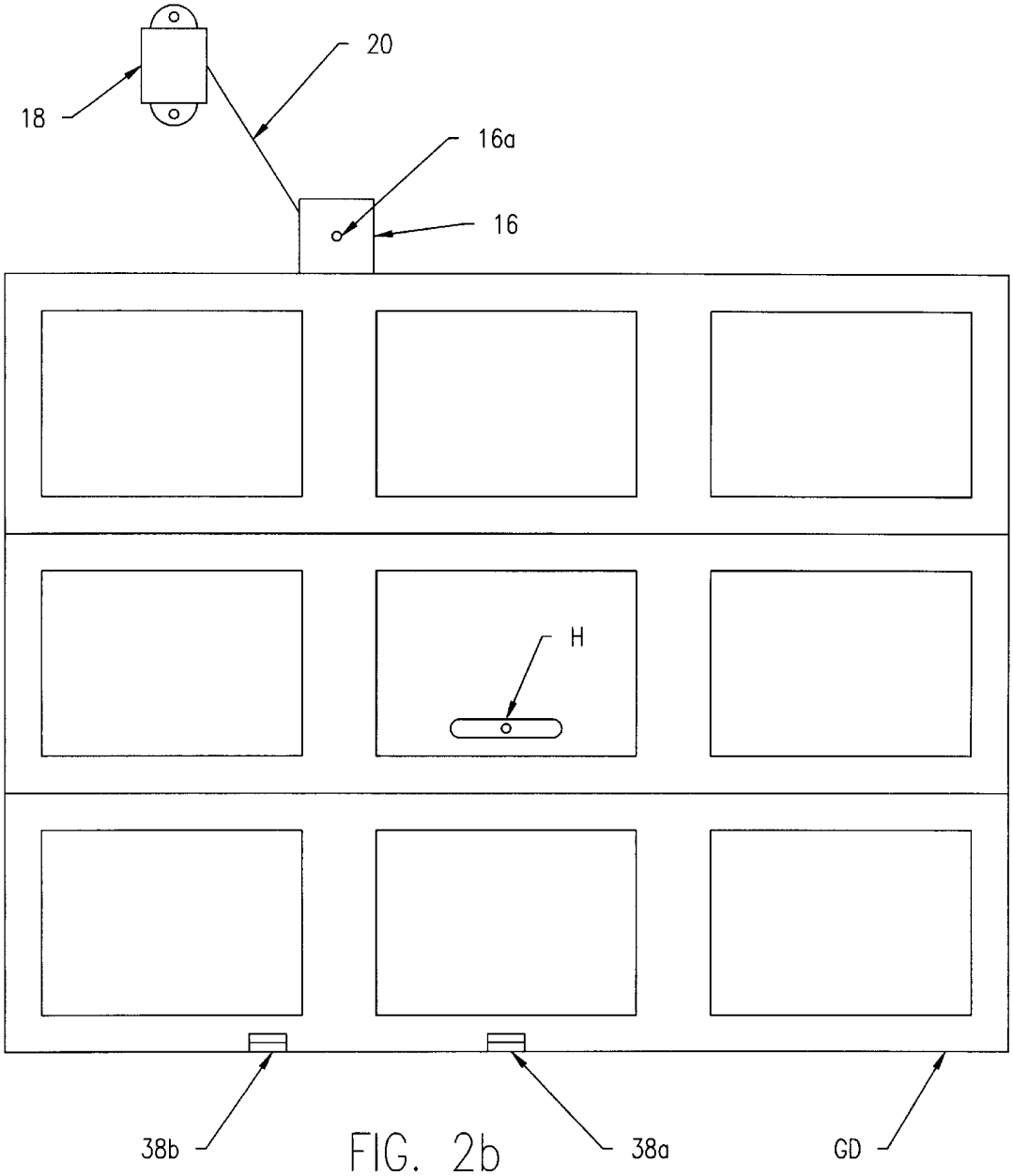
FIG. 2*b* is a front view of the first device of the garage door status indicating system attached above a conventional garage door in a second position using an additional bracket for activating the system.

For garage doors GD which fail to have the lower conventional bracket, or for owners who do not wish to utilize this bracket, a door switch bracket 38*b* can be secured to the lower area of the conventional garage door GD, as illustrated in FIG. 2*b*. The use of a door switch bracket provides for a second positioning or embodiment of the present invention. As shown in this figure, a door switch bracket 38*b* is secured to the lower area of the conventional garage door. This will provide for the door switch bracket 38*b* to contact and depress the button 16*a* of switch 16 when the door is in an opened position. Thereby, this door switch bracket 38*b* is linearly aligned with the switch 16. This will provide for activation to occur once the garage door is completely opened.

Figure 3A:
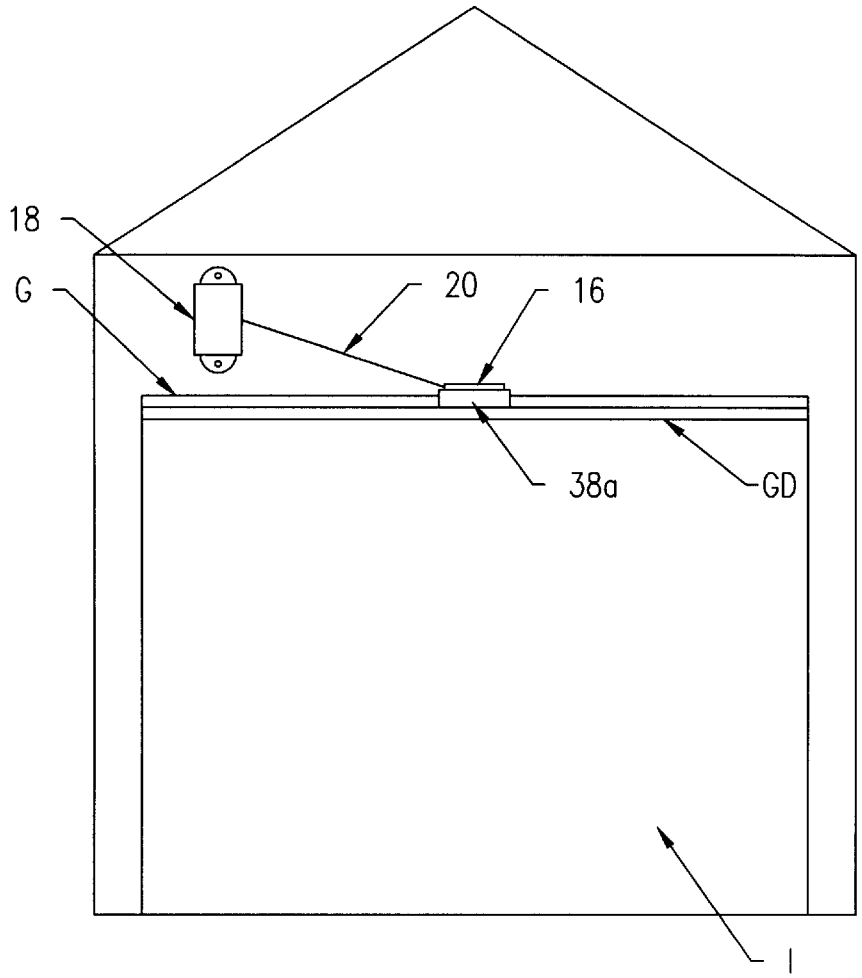
FIG. 3*a* is a front view of the garage door in an opened position illustrating a bracket, of either the first or second position, contacting the first device for activating the garage door status indicating system of the present invention.
Figure 3B:
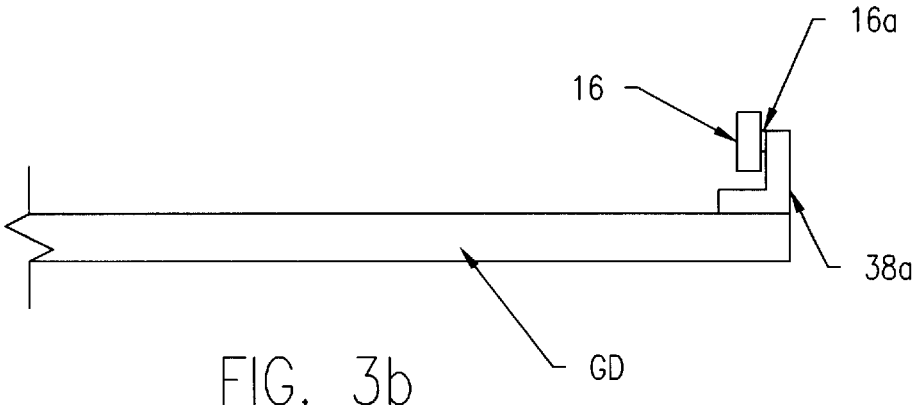
FIG. 3*b* is a side view of the garage door in an opened position illustrating a bracket, of either the first or second position, contacting the first device for activating the garage door status indicating system of the present invention.

As seen in FIGS. 3*a* and 3*b*, once the door GD is opened, the interior I of the garage is exposed, thereby enabling a vehicle to exit the garage. The L-shape bracket 38 contacts and depresses the button 16*a*. The depression will cause the switch 16 to close for activating the warning means of the second unit 14.

Figure 4:
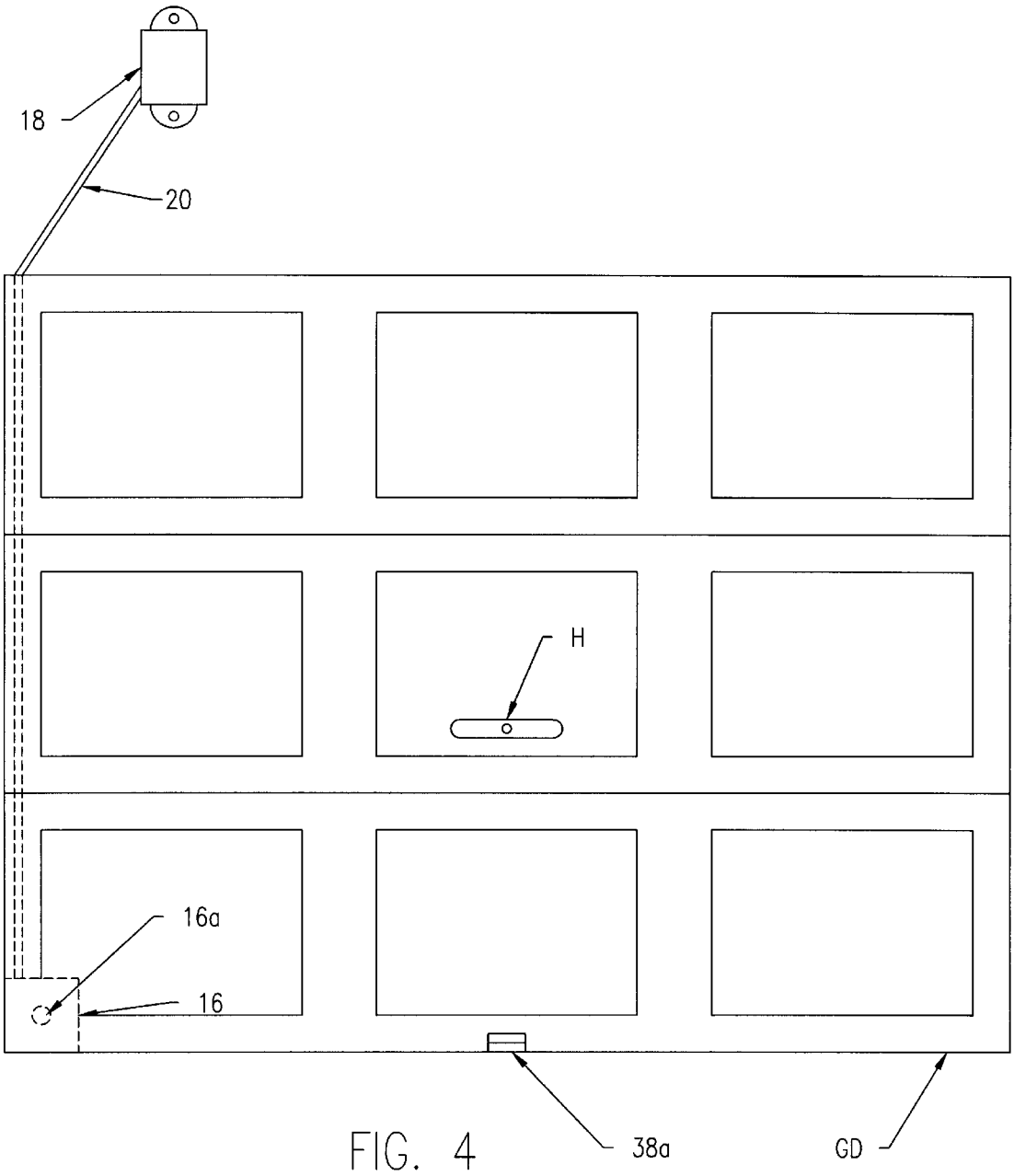
FIG. 4 is a front view of the first device of the i garage door status indicating system attached above a conventional garage door, in a third position, activation occurs without the use of a bracket.

The embodiments illustrated above, show a device which activates once the door is completely opened. However, for a situation wherein activation of the warning means occurs with a partially opened door, an alternative embodiment is shown in FIG. 4. As seen in this figure, the door switch 16 is secured to the lower area of the garage door frame. In a closed position, as illustrated, the button is -depressed, which causes the switch to be in an opened position. This will prohibit current to travel to the transmitter 18 via line 20, thus prohibiting activation of the transmitter. As the door opens, it moves away from the button, causing the button to eject forward. This causes the switch to close which will allow current to travel to the transmitter, enabling the transmitter to send signals to the receiver for activating the warning means.

It is noted that the location of the door switch bracket 38*b* can also be located in proximity to the upper door and contact the switch 16 when the door is in a closed position. This contact will depress the button 16*a* but will not cause the system to be activated, hence providing for a the depression of the button to cause for the switch to be opened. This opened position will prevent the activation of the system. In this configuration, the bracket is hingedly and pivotally secured the garage door. Hence, in this configuration when the door is opened, the bracket pivots back and cause the button to be release. This release will cause for the switch to close, thereby activating the system. When the door is closed, the bracket pivots back to its original position for contacting the button and causing the switch to be opened.

Figure 5:
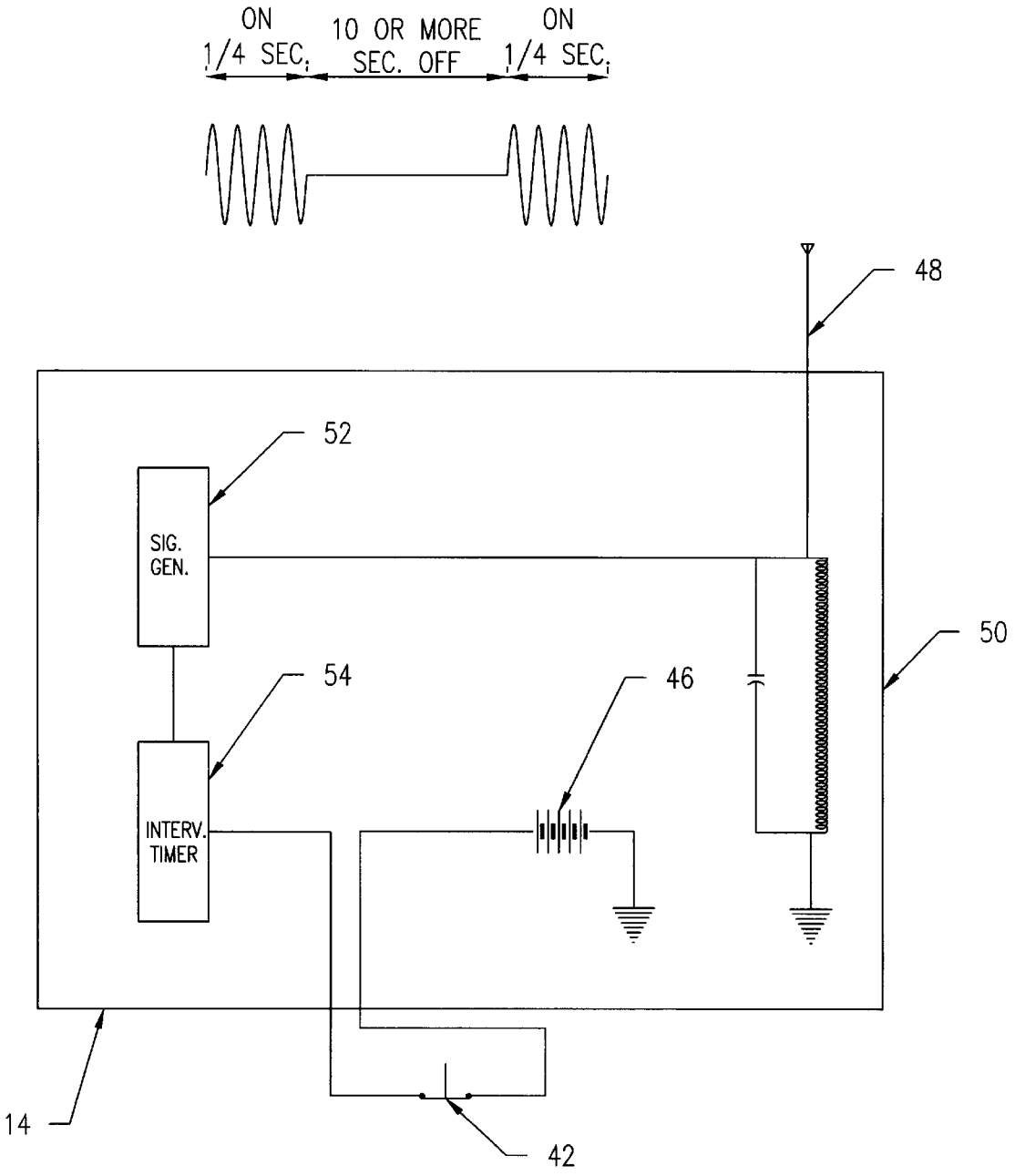
FIG. 5 is a schematic view of the first device of the garage door status indicating system of the present invention.
Figure 6:
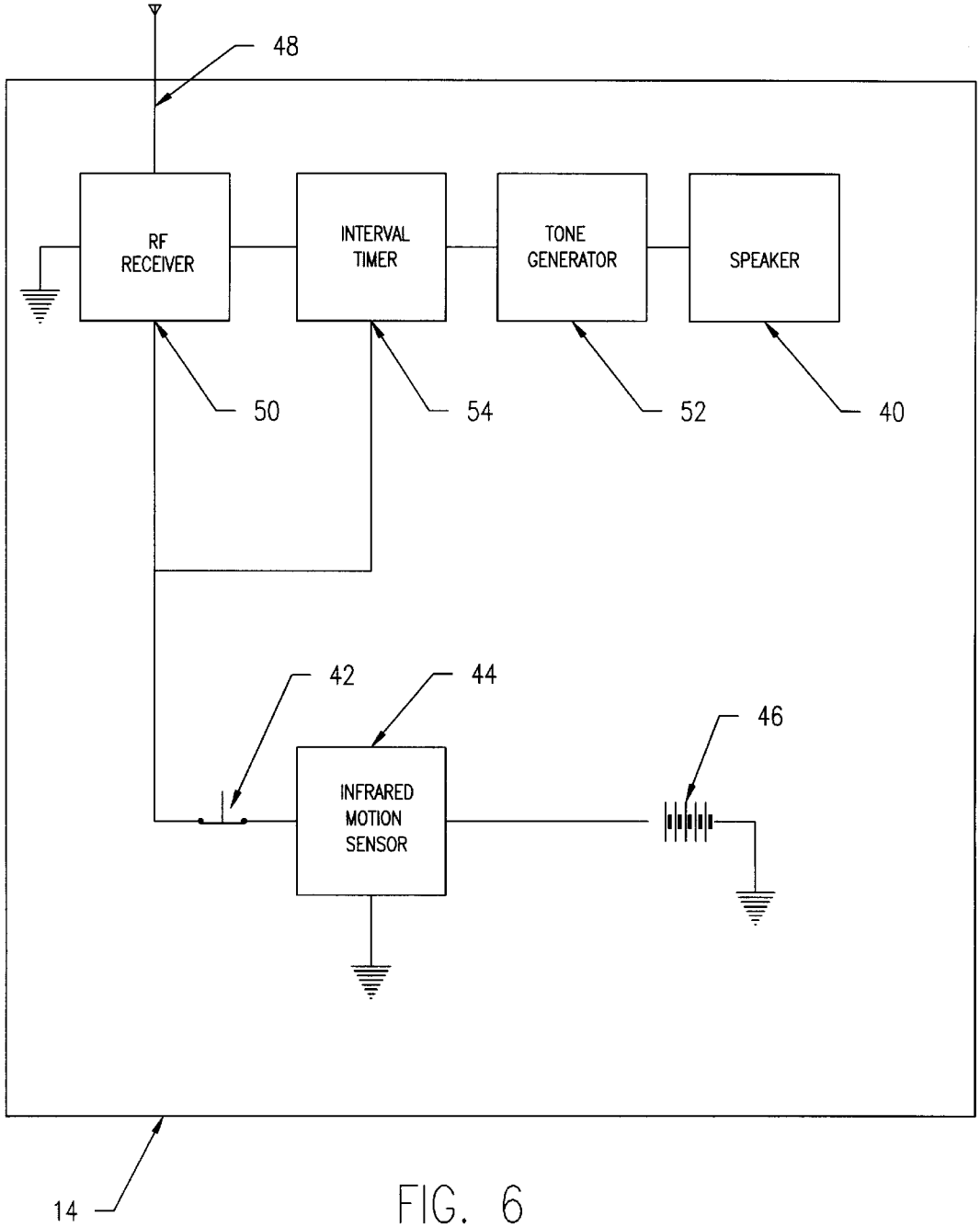
FIG. 6 is a schematic view of the second device of the garage door status indicating system of the present invention.

The circuitry used for the various embodiments above is illustrated in further detail in FIGS. 5 and 6. FIG. 5 shows the schematic illustration of the first device and FIG. 6 shows the schematic illustration of the second device. As seen in the schematic illustration in FIG. 5, the switch 16 is also coupled to a power source 46, such as conventional batteries or to existing wiring within the garage. When the garage door is in a closed position, the switch 16 is in an opened position, thereby prohibiting current to travel to the transmitter 18. The opening of the door, as shown in FIGS. 3*a* and 3*b*, will force the bracket 38 to depress button 16*a*. This will inherently cause the switch to close, as illustrated in FIG. 4, consequently providing for current to travel to the transmitter 18.

The transmitter 18, as seen in FIGS. 1*a*, 2*a*, 2*b*, 3*a*, and 5, is conventional and includes a signal generation 24 which is coupled to an interval timer 26. An inductor 28 and capacitor 30 are provided to act as a DC bypass filter network. The DC bypass filter will provide a DC path between the input or first device 12 and the output 32 for passing DC power to the antenna electronics of the second unit 14.

The signal generator 24 will allow for signal to be transmitted upon the activation or closing of the switch 16. The interval timer 26 can be set to space the signals transmit for a given length of time. For example, the timer 26 can be set to generate radio frequency signals every ¼ of a second for a period of ten seconds.

This first unit 12 can be housed within a singular unit or can be designed as two individual sub-units, as illustrated. In either case, the first unit 12 is attached in proximity to the garage door GD via conventional means, such as adhesives (caulk, cement), hook and loop material (VELCRO), or the like. As illustrated, the sub-units, transmitter 18 and switch 16, can each include brackets 34 for enabling the first device to be attached via screws or nails 36 to the side wall of the conventional garage or the conventional garage door frame. The door switch bracket 34 is located and secured to the lower area of the conventional door. This door switch bracket 34 is secured in the same matter and fashion as discussed for the sub-units of the first device 12.

Figure 1B:
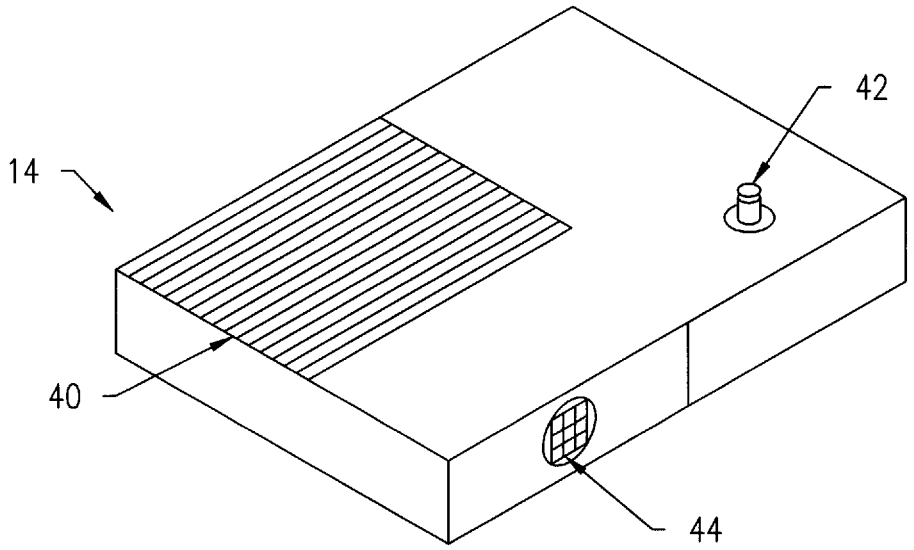
FIG. 1*b* is a perspective view of the second device used in the garage door status indicating system of the present invention.

The second device 14 is a receiver unit and is illustrated in further detail in FIGS. 1*b* and 6. As seen in these drawings, the second device 14 is compact. It is designed and configured to either be retrofitted with an existing automatic garage door opener or to be a separate entity.

The second device is deigned to alert the user of the status of the garage door. Hence when the door is in an opened position, a warning means 40 will be activated. The warning means 40 is conventional and can be an audible alarm (such as a beeping noise), a visual alarm (such as flashing -lights), or a combination thereof. The user can easily disable the warning means 40 by way of a push button switch 42. This switch will cause an opened circuit to exist and prohibit current to travel to the warning means, thereby disabling the second device 14. For conservation of power, a conventional infrared motion sensor 44 can be provided for detecting the presence of an individual. Once the presence is detected, then the second device 14 is activated via a power source 46 (such as batteries or the like).

As seen in FIG. 6, the signals from the transmitter of the first device enter the second device 14 via line 48 and are received by way of a conventional radio frequency (RF) receiver 50. The receiver is powered from the power source 46. The power source 46 may optionally be disable by either the push button switch 42 or by failure of detecting the presence of an individual by way of the motion sensor 44.

The received signals from the RF receiver 50 are transmitted to a tone generator 52. The tone generator is coupled to a speaker (alarm means 40) for allowing the tones to be heard. Optionally, the tone generator and speaker can be replace by a light source for allowing visual indicating means as opposed to audible indication means. Alternatively, the combination of an audible means and visual means can be utilized for the warning means.

An interval timer 54 can be coupled between the RF receiver 50 and warning means. This timer 54 will space the received signals for inherently spacing the output of the audible means or visual means. Thereby providing for either pulsing tone or pulsing light source. The timer is conventional and can be set for any spacing and for any length of time. For example, the timer 54 can be set to generate signals every ¼ of a second for a period of ten seconds. Thereby providing for a sound and/or light source to be generated (pulsated) every one quarter of a second.

As stated previously, this second device 14 can be retrofitted into an existing automatic garage door opener, by incorporating the unit 14 into the existing remote control of the conventional garage door opener. Optionally, should the user wish to utilize the unit, separate from the remote control of the garage door opener, the second device 14 can be situated within the vehicle, either permanently or removably. The second unit 14, as seen in FIG. 1*b*, can include an anti-skid layer 56, such as, but not limited to rubber. This anti-skid layer will provide a second device which will not skid on nor scratch the surface of which it rests on, such as the dash board of a vehicle.

While the invention has been particularly shown and described with reference to an embodiment thereof, it will be understood by those skilled in the art that various changes in form and detail may be made without departing from the spirit and scope of the invention.

We claim:

1. A garage door status indicating system used in combination with a garage door, said indicating system comprises:

a contact means is secured to a lower area of a garage door; and a first device and a second device;

said first device includes a first switch and a transmitter unit;

said first switch is electrically coupled to said transmitter unit; wherein said first switch is mounted above the garage door and is linearly aligned with said contact means;

said second device includes a receiver unit and a warning means;

said receiver unit is electrically coupled to said warning means;

said second device is used for reminding a user to close the opened garage door; and said second device is located away from the garage door and in a close proximity to the user's active area such that the user could see a warning signal from the warning means easily; wherein said second device only activated upon the sensed of the presence of the user by a motion sensor;

said transmitter unit includes a transmitting means for transmitting signals and said receiver unit includes a receiving means of receiving said transmitted signals;

said contact means contacts and closes said first switch when said garage door is in an opened position for rendering current to travel to said transmitter unit, said transmitter unit transmits said signals to said receiver unit, and said received signals are received via said receiving means for activating said warning means.

2. A garage door status indicating system as in claim 1 wherein said second device includes a silence push button switch for disabling said warning means.

3. A garage door status indicating system as in claim 1 wherein said second device includes an infrared motion sensor, said infrared motion sensor is coupled to a power source for powering said second device, said infrared motion sensor controls activation of said second device, said second device is activates upon the presence of an individual.

4. A garage door status indicating system as in claim 1 wherein said transmitting means is a signal generator.

5. A garage door status indication system as in claim 1 wherein said receiving means is a radio frequency receiver.

6. A garage door status indication system as in claim 4 wherein said receiving means is a radio frequency receiver.

7. A garage door status indication system as in claim 1, wherein said contact means is a door switch bracket, and said door switch bracket is vertically aligned with said first switch.

8. A garage door status indication system as in claim 1 wherein said contact means is a garage door bracket, and said conventional garage door bracket is vertically aligned with said first switch.

9. A garage door status indicating system used in combination with a garage door, said indicating system comprises:

a first device and a second device;

said first device includes a first switch and a transmitter unit;

said first switch is electrically coupled to said transmitter unit;

said second device includes a receiver unit and a warning means;

said receiver unit is electrically coupled to said warning means;

said second device is used for reminding a user to close the opened garage door; and said second device is located away from the garage door and in a close proximity to the user's active area such that the user could see a warning signal from the warning means easily; wherein said second device only activated upon the sensed of the presence of the user by a motion sensor; wherein said second device includes a silence push button switch for disabling said warning means;

said transmitter unit includes a transmitting means for transmitting signals and said receiver unit includes a receiving means of receiving said transmitted signals;

said first switch is secured to a lower area of a garage door frame, said first switch contact the garage door of said garage door frame, contacting said garage door provides for said switch to be in an opened position, and upon opening said garage door said contact switch closes for rendering current to travel to said transmitter unit, said transmitter unit transmits said signals to said receiver unit, and said received signals are received via said receiving means for activating said warning means.

10. A garage door status indicating system as in claim 9 wherein said second device includes an infrared motion sensor, said infrared motion sensor is coupled to a power source for powering said second device, said infrared motion sensor controls activation of said second device, said second device is activates upon the presence of an individual.

11. A garage door status indicating system as in claim 9 wherein said transmitter means is a signal generator.

12. A garage door status indication system as in claim 9 wherein said receiving means is a radio frequency receiver.

13. A garage door status indication system as in claim 11 wherein said receiving means is a radio frequency receiver.

* * * * *